US007044412B2

(12) United States Patent
Hemond et al.

(10) Patent No.: US 7,044,412 B2
(45) Date of Patent: May 16, 2006

(54) SEALED CABLE DRUM ASSEMBLY

(75) Inventors: Stéphane Hemond, Beaune la Rolande (FR); Laurent Arquevaux, Sully sur Loire (FR); Hervé Laurandel, Herouville Saint Clair (FR); Mark Lawrie, Lion en Sullias (FR); Jens Seibert, Checy (FR); Christophe Truffaut, St Jean le Blanc (FR)

(73) Assignee: ArvinMeritor Light Vehicle Systems-France, Sully-sur-Loire (FR)

( * ) Notice: Subject to any disclaimer, the term of this patent is extended or adjusted under 35 U.S.C. 154(b) by 36 days.

(21) Appl. No.: 10/368,544

(22) Filed: Feb. 18, 2003

(65) Prior Publication Data

US 2003/0160124 A1 Aug. 28, 2003

(30) Foreign Application Priority Data

Feb. 22, 2002 (FR) ..... 02 02279
Jan. 23, 2003 (FR) ..... 03 00720

(51) Int. Cl.
*B65H 75/48* (2006.01)

(52) U.S. Cl. ..... 242/390.8; 74/89.22

(58) Field of Classification Search ..... 242/390.8, 242/396.5; 49/352, 332, 348, 349, 501, 502; 74/501.5, 502.6, 425, 505, 625, 89.22; 475/149
See application file for complete search history.

(56) References Cited

U.S. PATENT DOCUMENTS 4,428,250 A * 1/1984 Becker et al. ..... 74/425
4,503,732 A * 3/1985 Schust ..... 74/625
4,770,056 A * 9/1988 Becker et al. ..... 74/505
4,821,589 A * 4/1989 Fukumoto et al. ..... 74/89.22
5,027,670 A * 7/1991 Adam ..... 74/425
5,199,310 A * 4/1993 Yoshimura
5,207,393 A * 5/1993 Marscholl ..... 242/396.5
5,511,443 A * 4/1996 Munekhoff ..... 74/505
5,564,231 A * 10/1996 Tajima et al. ..... 49/352
5,960,588 A * 10/1999 Wurm et al. ..... 49/352
6,094,868 A * 8/2000 Otaka et al. ..... 49/349
6,152,646 A 11/2000 Muller-Blech et al.
6,253,491 B1 * 7/2001 Pages ..... 49/352
6,305,129 B1 * 10/2001 Eckhardt et al. ..... 49/502
6,427,386 B1 * 8/2002 Kalb et al. ..... 49/349
6,574,922 B1 * 6/2003 Velthaus et al. ..... 49/352
6,629,905 B1 * 10/2003 Sesselmann et al. ..... 475/149
6,634,142 B1 * 10/2003 Dobson et al. ..... 49/352

FOREIGN PATENT DOCUMENTS

DE 198 12 875 C 1 6/1999
WO WO 97/43564 11/1997

OTHER PUBLICATIONS

Search report, dated Oct. 22, 2002.

* cited by examiner

*Primary Examiner*—William A. Rivera
(74) *Attorney, Agent, or Firm*—Carlson, Gaskey & Olds

(57) ABSTRACT

A device for a window lifter of a vehicle door includes a cable winding drum disposed inside a housing of a casing and a seal attached to the casing. The seal includes a stop portion that prevents translational movement of the drum along its rotational axis while still allowing the drum to rotate freely about the axis. The inventive device allows the drum to be held in the housing before the casing is mounted on a dividing panel without requiring auxiliary parts to hold the drum in place and without compromising the seal when the casing is fastened to or removed from the dividing panel.

13 Claims, 3 Drawing Sheets

SEALED CABLE DRUM ASSEMBLY

REFERENCE TO RELATED APPLICATIONS

The present invention claims priority to French Patent Application Nos. 02 02279, filed Feb. 22, 2002, and 03 00 720, filed Jan. 23, 2003.

TECHNICAL FIELD

The invention relates to motor vehicle doors and in particular to window lifters of doors equipped with an electric motor drive.

BACKGROUND OF THE INVENTION

Various structures have been proposed for window lifter systems having a winding drum, a geared motor unit operatively coupled to the drum to turn the drum, and a drum casing that accommodates the drum. A seal is often used to hold the drum in the drum casing, but it is difficult to obtain an effective seal without adversely affecting drum rotation.

European Patent EP-B-0 892 724 discloses a sheet metal door with openings. A plastic winding drum turns inside a drum casing and is lodged between the sheet metal and the casing. The drum casing is fastened to the drum with a resilient clip fastener. The sheet metal has a bore through which the fastener is inserted. The geared motor unit and its associated motor unit casing is disposed on the sheet metal and attached to the drum so that the sheet metal is sandwiched between the drum casing and the motor unit casing. The motor unit casing is fixed to the drum casing with a screw housed in the resilient clip fastener.

Likewise, U.S. Pat. No. 6,152,646 discloses a support plate supporting a geared motor unit casing and a drum casing on either side of the support plate. The geared motor unit casing is fixed to the drum casing with a screw passing through the casings.

The devices described above have several disadvantages, however. On the one hand, the structures described above do not provide secure sealing between the two faces of the sheet metal or adequate support at the juncture between the geared motor unit and drum casings. Secure sealing is particularly important to protect the electrical and electronic components of the geared motor unit from moisture. On the other hand, currently known structures do not align the drum correctly in the drum casing before the drum casing is fastened to the sheet metal, potentially causing the drum to deviate from its optimal position within the casing.

One way to optimize drum positioning within the casing is to form a seal that contacts the drum to hold the drum in place. DE-A-19 812 875 discloses a window lifter with a drum casing and a seal where the seal is urged against a lateral surface of the drum. The seal provides a sealing function and also holds the drum on its axis of rotation via frictional contact. However, the friction between the drum and the seal causes conflict between providing a secure seal between the drum and the seal and holding the drum to prevent translation of the drum along its rotational axis. Furthermore, the friction between the seal and the drum tends to deteriorate the seal, degrading both the sealing power and the translational holding power of the seal against the drum.

U.S. Pat. No. 4,503,732 discloses a window lifter drum mounted to turn inside a box. The faces of the drum each have a seal that is integrally formed with the drum to provide a seal between the drum and the box. Although the integral seal does provide tight sealing, it also impedes free rotation of the drum within the box.

International Application WO-A-97 43 564 discloses a geared motor unit for a window lifter. The geared motor unit includes a seal that contacts a toothed wheel driven by the geared motor unit. The seal slides against an interior annular wall of the toothed wheel.

There is therefore a need for a device and a method of assembly which solve one or more of the disadvantages of currently known structures.

SUMMARY OF THE INVENTION

The present invention is directed to a device for a window lifter system in a vehicle. The device has a cable winding drum that turns about an axis, a casing with a housing in which the drum is arranged, and a seal that holds the drum in the housing and acts as a stop that prevents translation of the drum along this axis.

In one embodiment, the seal surrounds the periphery of an opening in the housing. In another embodiment, the seal is fixed to the casing with studs.

The seal may also have a first region that contacts the casing and a second region that faces away from the housing. In this embodiment, the first and second regions are made of different materials, with the material used in the second region more flexible than the material used in the first region. The first material is, for example, polypropylene reinforced with 20% glass fiber. The second material is, for example, ethylene-propylenediene monomer (EPDM).

According to one embodiment, the seal has at least one opening surrounded by a bulge or bead.

According to another embodiment, the device further comprises a dividing panel fixed to the seal. In this case, the seal is held between the dividing panel and the casing. The second region of the seal may contact the dividing panel.

According to yet another embodiment, the seal is fixed to the dividing panel by at least one resilient clip fastener. The dividing panel itself may be an interior door panel.

According to one embodiment, the device further comprises a geared motor unit coupled to the drum. The geared motor unit is equipped with a box fixed to the casing. The seal and the dividing panel is held between the box and the casing. The seal, the box and the panel provide sealing between the two faces of the panel.

The invention is also directed to a method of assembling a door, comprising the steps of placing a cable winding drum in the housing of a casing such that the drum can turn about an axis and fixing a seal that holds the drum in the housing to the casing. The seal acts as a stop to prevent translation of the drum along its rotational axis. The method also comprises winding a cable onto the drum, placing a dividing panel against the seal, coupling a geared motor unit to the drum and fixing a box of the geared motor unit to the casing to hold the dividing panel and the seal between the box and the casing.

According to one embodiment, the dividing panel is placed against the seal by fastening the seal to the panel.

Other features and advantages of the invention will become apparent from reading the description which follows of some embodiments of the invention, which is given by way of example and with reference to the appended drawings.

DETAILED DESCRIPTION OF PREFERRED EMBODIMENTS

The invention proposes a device for a window lifter for a vehicle. Generally, the device comprises a drum, a casing that houses the drum, and a seal that holds the drum in the housing before the casing is fastened to a dividing panel. The drum has an axis of rotation. The seal has a portion that acts as a stop for the drum, preventing the drum from translating along its axis of rotation.

Figure 1:
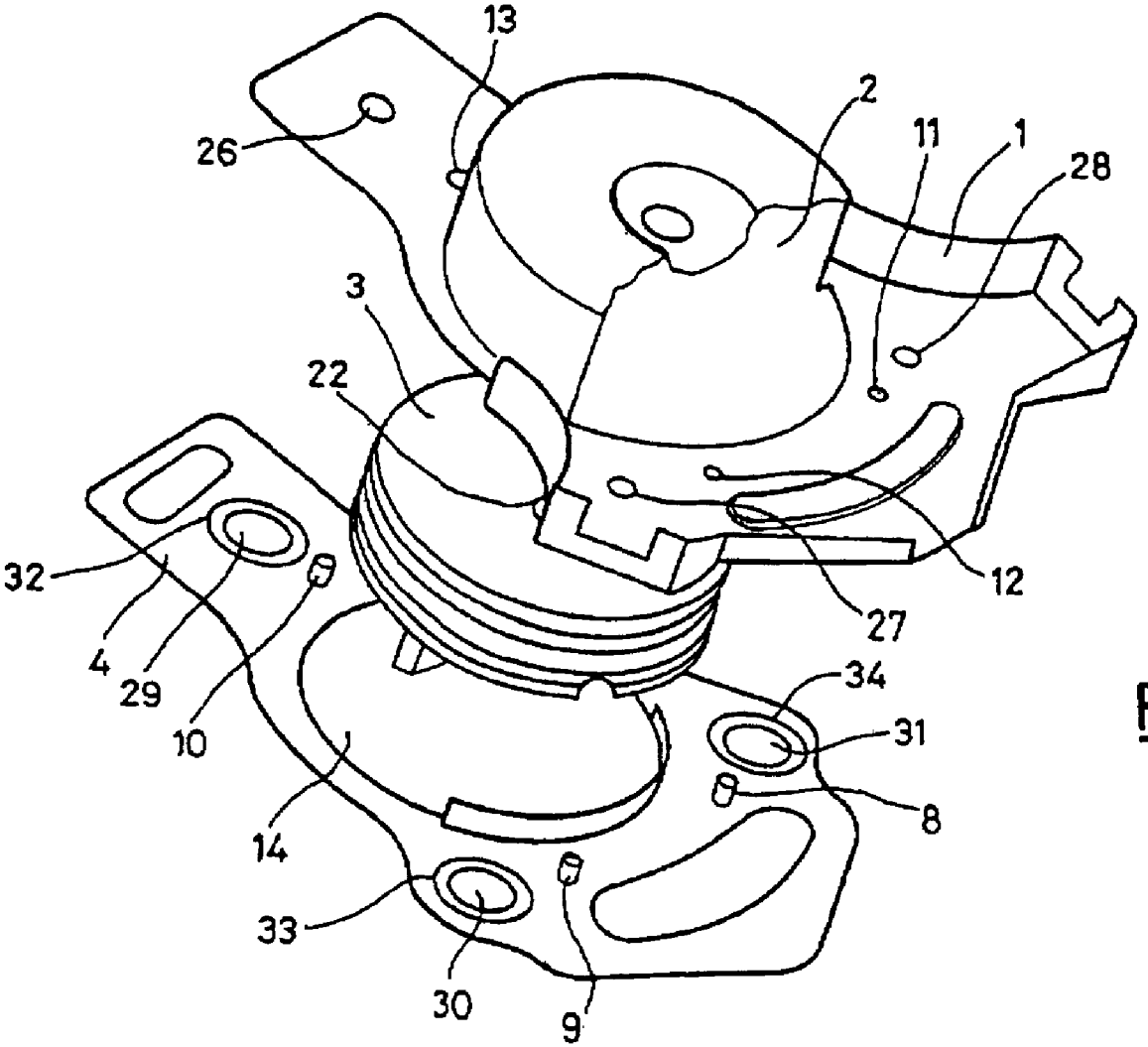
FIG. 1 is an exploded perspective view of a device according to one embodiment of the invention.

FIG. 1 illustrates a perspective view of the device before it is assembled. The device comprises a drum casing 1 having a drum housing 2, a cable winding drum 3 to be inserted in the housing 2 and a seal 4 fastened to the casing 1 to hold the drum 3 in the housing 2.

By placing the drum 3 in the housing 2 and then fastening the seal 4 to the casing 1, the drum 3 is held securely in the housing 2. The housing 2 forms a cavity that opens toward a circular drum insertion opening 14 in the seal 4. The drum 3 has two faces, one on each side of the drum along the axis of rotation of the drum 3. One face of the drum projects toward the seal 4, while the other face of the drum is disposed toward the end of the casing.

The opening 14 of the seal 4 has a diameter that is smaller than the diameter of the drum 3 so that the seal 4 can stop translational movement of the drum 3 along the drum's axis of rotation. Thus, the drum 3 is held between one surface of the seal 4 and the casing 1 in its axial direction. The seal 4 allows the device to be handled without the risk of the drum 3 inadvertently coming out of the housing 2. In addition, the seal 4 can be used as a seal for a door dividing panel, which will be explained in greater detail below.

The inventive structure is particularly practical when the vehicle is being serviced because it is possible to remove a geared motor unit 6 from the vehicle without removing the drum 3. Furthermore, the sealing characteristics of the seal 4 are not compromised even though the seal 4 blocks translational movement of the drum 3 because the seal 4 does not frictionally contact the drum 3. Because of these characteristics, it is possible to service the geared motor unit that drives the drum 3 without compromising the sealing action of the seal 4.

Figure 2:
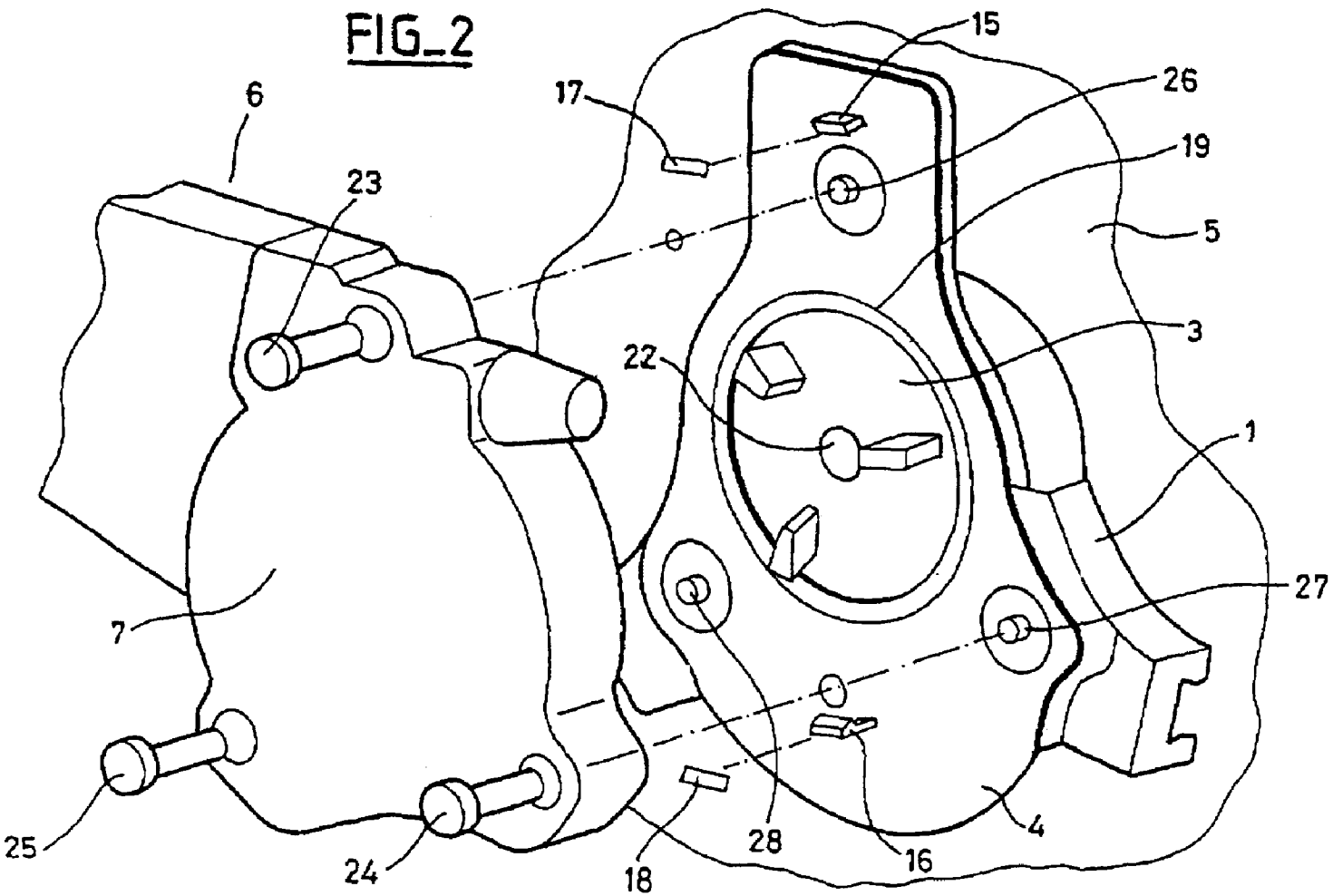
FIG. 2 is a perspective view of the device of FIG. 1.

Door dividing panels are commonly used in window lifters with geared motor units to define and isolate a wet region containing mechanical window driving elements and a dry region containing an electrical or electronic part of the window drive mechanism. These regions may be defined by the seal 4. As depicted in FIG. 2, the seal 4 can be fastened to a dividing panel 5 of a door. The seal 4 is then held between the dividing panel 5 and the casing 1. The casing 1 and the drum 3 held in the housing 2 of the casing 1 are therefore supported by the dividing panel 5, independently of the geared motor unit 6.

By keeping the casing 1, drum 3 and seal 4 separate and independent from the geared motor unit 6 when they are mounted to the dividing panel 5, the geared motor unit 6 can be attached to and removed from the drum 3 without any effect on the drum 3 or the seal 4. As shown in FIG. 2, the geared motor unit 6 can be coupled to the drum 3, and a box 7 for the geared motor unit 6 can be fastened to the casing 1. The dividing panel 5 and the seal 4 are then held between the casing 1 of the drum 3 and the box 7 of the geared motor unit 6. The dividing panel 5 isolates and seals the drum 3 and the geared motor unit 6 from each other, defining a wet region for the drum 3 and a dry region for the geared motor unit 6 and its associated electronic components. A method of assembling a door incorporating the inventive device will be described in greater detail below.

As shown in FIG. 2, the seal 4 has the opening 14 which generally aligned with an open portion of the housing 2. The seal 4 therefore provides sealing around the open portion of the housing 2 while still allowing the drum 3 to be exposed through the housing 2 and the opening 14 in the seal 4. The geared motor unit 6 can therefore be coupled to the exposed portion of the drum 3 through the opening 14 even if the drum 3 and its associated casing 1 are already built into a door.

In the example of FIG. 1, the casing 1 and the seal 4 each have a flat surface. The seal 4 is cut into a shape that matches the profile of the casing 1 so that the flat surfaces of the casing 1 and the seal 4 form a tight seal against each other. The seal 4 may also include studs 8, 9, 10 adapted to engage with holes 11, 12, 13 in the casing 1. When the studs 8, 9, 10 in the seal 4 are inserted through the holes 11, 12, 13, the studs 8, 9, 10 hold the seal 4 against the casing 1. Instead of studs 8, 9, 10, clip fasteners or any other fastener structure may be used to attach the seal 4 to the casing 1.

Figure 3:
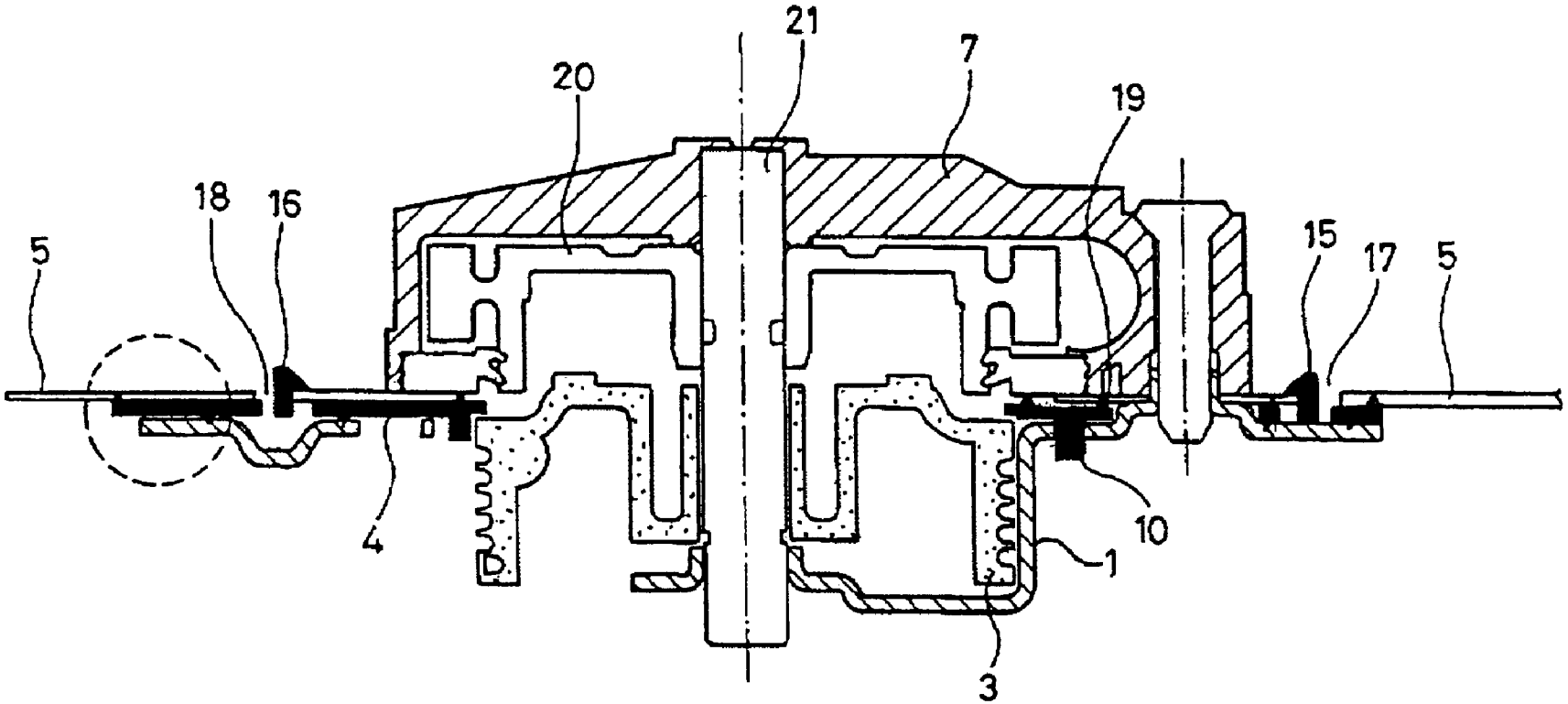
FIG. 3 is a section view of the device of FIG. 1.

Note that multiple types of fasteners may be used in the same device. As shown in FIG. 3, the seal 4 may be formed with clip fasteners 15, 16 in addition to the studs 8, 9, 10. In this case, the studs 8, 9, 10 are designed to connect with the casing 1 and the clip fasteners 15, 16 are designed to connect with the dividing panel 5. The properties of the material used to form the seal 4 may cause the clip fasteners 15, 16 to be resilient. In the embodiment shown in FIG. 3, the seal 4 has two clip fasteners 15, 16 that engage with corresponding openings 17, 18 in the dividing panel 5. Once the dividing panel 5 and the seal 4 have been attached together via the clip fasteners 15, 16, the seal 4 is held between the dividing panel 5 and the casing 1. The dividing panel 5 is preferably an internal panel of a door structure.

In one embodiment, the seal 4 may include multiple layers or multiple regions having different properties. By forming different regions in the seal 4 having different properties based on the component that the region contacts, the seal 4 can have enough stiffness to support the drum while still having enough flexibility to create a tight seal. In one embodiment, a first region that faces the drum 3 to hold the drum in the casing 1 preferably has a Young's modulus greater than that of a second region that contacts the dividing panel 5 and/or the casing 1. This results in a first region that has the mechanical stiffness necessary to hold the drum firmly and a second region that deforms enough to provide a good seal against the dividing panel 5 and/or the casing 1. In one embodiment, the first region is made of polypropylene reinforced with 20% glass fiber or polyoxymethylene acetal polymer (POM) for the first region. The first region may also be made of a metallic material formed into a thin plate to support the second region. Ethylene-propylene-diene monomer (EPDM) or a similar flexible material may be used in the second region. The seal 4 may also incorporate a third region that faces the casing 1 and is also made of flexible material.

As shown in FIGS. 2 and 3, the geared motor unit 6 is coupled to the drum 3 by a driving wheel 20. The coupling between the drum 3 and the wheel 20 can have any suitable structure within the capabilities of those of ordinary skill in the art. For example, the coupling can be a damper equipped with slots to accommodate grooves formed in the drum 3 and the wheel 20. A fixed spindle 21 of the geared motor unit 6 passes through a bore 22 in the drum 3 to guide the rotation of the drum 3. Fasteners, such as screws 23, 24, 25, attach the box 7 of the geared motor unit 6 to the casing 1 of the drum 3. The screws 23, 24, 25 pass through openings in the dividing panel 5 to connect the box 7 and the casing 1. The screws 23, 24, 25 also preferably pass through openings 29, 30, 31 in the seal. By extending the seal 4 beyond the vicinity of the drum 3 to areas where the screws 23, 24, 25 are located, the seal 4 provides even more secure sealing on the dividing panel 5.

The screws 23, 24, 25 may be fixed to corresponding shaped bores 26, 27, 28 in the drum casing 3. Once the box 7 has been fastened to the casing 1, the seal 4 and the dividing panel 5 are held between the box 7 and the casing 1. The resulting structure provides secure sealing for the geared motor unit 6 and the drum 3. The sealing action of the seal 4 can be supplemented at the periphery of the dividing panel 5 by any known means, such as a seal in the door structure to which the dividing panel 5 is fastened.

In one embodiment, the seal 4 may be formed with a bulge or bead 19 formed at peripheral areas (e.g., areas surrounding openings in the casing 1 or dividing panel 5) on either one or both of its faces. The bead 19 is then deformed by compression against a flat surface, such as the casing 1 or the dividing panel 5, to improve the sealing properties of the seal 4. As shown in FIGS. 2 and 3, the bead 19 may be formed on the seal 4 in any area that surrounds an opening in the dividing panel 5, such as the opening 14. Additional beads 32, 33, 34 may be formed around the screw openings 29, 20, 31 to improve sealing even further.

To assemble a vehicle door having the inventive assembly, the drum 3 is first placed in the housing 2 of the casing 1. The seal 4, which holds the drum 3 in the housing 2, is then fastened to the casing 1. A cable (not shown) is then wound around the drum 3. During the winding process, the cable may be tensioned so that the cable sits securely in the grooves of the drum 3. The drum and its associated casing 1 is then placed against the dividing panel 5. Alternatively, the seal 4 may be fastened to the dividing panel 5 instead of the casing 1 to streamline handling and to facilitate assembly of the door.

The geared motor unit 6 is then connected to the drum 3. The box 7 associated with the geared motor unit 6 is fastened to the casing 1 to hold the dividing panel 5 and the seal 4 between the box 7 and the casing 1. The area between the geared motor unit box 7 and the casing 1 is therefore effectively sealed, isolating the geared motor unit 6 and the drum 3 from each other and protecting them from outside damage.

The present invention is not restricted to the examples and embodiments described above and encompasses variations accessible to those skilled in the art. For example, the seal 4 may have a rigid mounting plate with a plastic overmold, where the rigidity of the mounting plate holding the drum 3 in the casing 1 and the overmold providing the sealing function. Further, the seal 4 may be attached to the dividing panel 5 and/or the casing 1 with resilient clip fasteners attached to the rigid mounting plate. Alternatively, the mounting plate itself may have portions that are bent to form fasteners. Any fastener structure that can hold the drum 3 in the casing 1 or the seal 4 on the dividing panel 5, even temporarily, is suitable for the invention. Furthermore, the top of the drum 3 may have a groove between the upper and lower faces of the drum 3 to accommodate the seal 4. In this case, the seal 4 contacts a lateral face of the groove to act as a stop and prevent translation of the drum 3.

It should be understood that various alternatives to the embodiments of the invention described herein may be employed in practicing the invention. It is intended that the following claims define the scope of the invention and that the method and apparatus within the scope of these claims and their equivalents be covered thereby.

What is claimed is:

1. A device for a window lifter comprising:

a cable winding drum;

a casing having a housing that accommodates the cable winding drum, wherein the cable winding drum turns inside the housing about a rotational axis; and a seal attached to the casing, the seal having a stop portion that prevents translation of the cable winding drum along the rotational axis, wherein the seal includes:

a first region that contacts the casing, and a second region facing away from the housing, wherein the first region is made of a first material and the second region is made of a second material that is more flexible than the first material.

2. The device of claim 1, further comprising a third region facing toward the housing, wherein the third region is made of a third material that is more flexible than the first material.

3. The device of claim 2, wherein the first material is polypropylene strengthened with glass fiber.

4. The device of claim 1, wherein the first material is polypropylene strengthened with glass fiber.

5. The device of claim 1, wherein the second material is ethylene-propylene- diene monomer (EPDM).

6. The device of claim 1, further comprising a dividing panel attached to the seal such that the seal is disposed between the dividing panel and the casing.

7. The device of claim 6, wherein the second region contacts the dividing panel.

8. The device of claim 6, wherein the seal is attached to the dividing panel with a clip fastener.

9. The device of claim 6, wherein the device further comprises:

a geared motor unit that is coupled to the cable winding drum; and a box associated with the geared motor unit and fixed to the casing such that the seal and the dividing panel are disposed between the box and the casing.

10. The device of claim 9 further comprising a box associated with the geared motor unit and fixed to the casing such that the seal and the dividing panel are disposed between the box and the casing.

11. The device of claim 6, wherein the dividing panel is an interior door panel.

12. A method of assembling a vehicle door comprising the steps of:

placing a cable winding drum in a housing of a casing such that the cable winding drum can rotate about a rotational axis;

attaching a substantially planar seal to the casing, wherein the substantially planar seal holds the cable winding drum in the housing and the substantially planar seal includes a substantially planar stop portion that prevents translation of the cable winding drum along the rotational axis and at least one seal opening surrounded by a deformable bead, wherein the substantially planar seal includes a first region that contacts the casing and a second region facing away from the housing, wherein the first region is made of a first material and the second region is made of a second material that is more flexible than the first material;

winding a cable onto the cable winding drum;

placing a dividing panel against the substantially planar seal;

coupling a geared motor unit to the cable winding drum through the at least one seal opening; and fixing a box associated with the geared motor unit to the casing, wherein the dividing panel and the substantially planar seal are held between the box and the casing.

13. The method of claim 12, wherein the step of placing the dividing panel against the substantially planar seal comprises fastening the substantially planar seal to the dividing panel with at least one fastener.

* * * * *